US007874764B2

(12) United States Patent
Fossen et al.

(10) Patent No.: US 7,874,764 B2
(45) Date of Patent: Jan. 25, 2011

(54) SECONDARY CONTAINMENT SYSTEM FOR AN ABOVE-GROUND PETROLEUM STORAGE TANK

(75) Inventors: Peter Van Fossen, 235 W. Brandon Blvd., Brandon, FL (US) 33511; Michael Whitener, Fort Myers, FL (US)

(73) Assignee: Peter Van Fossen, Brandon, FL (US)

( * ) Notice: Subject to any disclaimer, the term of this patent is extended or adjusted under 35 U.S.C. 154(b) by 29 days.

(21) Appl. No.: 12/462,749

(22) Filed: Aug. 7, 2009

(65) Prior Publication Data

US 2009/0324336 A1 Dec. 31, 2009

Related U.S. Application Data

(63) Continuation-in-part of application No. 12/215,615, filed on Jun. 27, 2008, now abandoned.

(51) Int. Cl.
*B65D 90/48* (2006.01)

(52) U.S. Cl. ..... 405/60; 405/52

(58) Field of Classification Search ..... 405/52, 405/60, 107, 129.45, 129.5, 129.55, 129.57, 405/129.6, 129.7, 129.75, 129.85
See application file for complete search history.

(56) References Cited

U.S. PATENT DOCUMENTS 4,765,775 A * 8/1988 Kroger ..... 405/52
4,935,726 A * 6/1990 Buro et al. ..... 340/603
5,067,850 A * 11/1991 Gray ..... 405/92
5,248,220 A * 9/1993 Rohringer ..... 405/53
5,288,168 A * 2/1994 Spencer ..... 405/54
5,454,195 A * 10/1995 Hallsten ..... 52/169.1
5,569,372 A * 10/1996 Smith ..... 210/85
5,800,091 A * 9/1998 Van Romer ..... 405/52
5,820,297 A * 10/1998 Middleton ..... 405/52
5,882,142 A * 3/1999 Siglin et al. ..... 405/52
6,503,390 B1 * 1/2003 Gannon ..... 210/164
6,695,534 B2 * 2/2004 Cain et al. ..... 405/52
6,841,077 B2 * 1/2005 Gannon et al. ..... 210/692
6,854,926 B2 * 2/2005 Siglin et al. ..... 405/52
7,041,213 B1 * 5/2006 McClanahan ..... 210/85
7,494,298 B2 * 2/2009 Perkins ..... 405/129.55
2004/0234338 A1 * 11/2004 Monroe et al. ..... 405/54
2008/0135064 A1 * 6/2008 Knudsen ..... 134/10

* cited by examiner

*Primary Examiner*—Frederick L Lagman
(74) *Attorney, Agent, or Firm*—William E. Noonan

(57) ABSTRACT

A secondary containment system for an above-ground petroleum storage tank includes a berm rising above the ground surrounding the tank and spaced apart from the tank for defining a petroleum retention basin about the tank. An impermeable liner covers the ground between the tank and the berm. At least one drain is formed through the liner and into the underlying ground. A hydrocarbon sensor monitors the presence of petroleum in the drain. A control device responds to the presence of petroleum in the drain by closing a containment valve to prevent discharge of petroleum from the basin. An indicator device provides at least one of an audible and visible signal indicating that petroleum is sensed in the drain.

20 Claims, 5 Drawing Sheets

SECONDARY CONTAINMENT SYSTEM FOR AN ABOVE-GROUND PETROLEUM STORAGE TANK

RELATED APPLICATION

This application is a continuation in part of U.S. patent application Ser. No. 12/215,615 filed Jun. 27, 2008, now abandoned.

FIELD OF THE INVENTION

This invention relates to a secondary containment system for an above-ground petroleum storage tank and, more particularly, to a system for capturing petroleum that has spilled from the tank. Electronic sensors and controls are utilized to provide immediate audible and/or visual warning of a fuel leak, tank overfill or other spill condition. This enables prompt, corrective action to be taken.

BACKGROUND OF THE INVENTION

Above-ground ground petroleum storage tanks are widely utilized. When a storage tank is overfilled or when fuel otherwise leaks or spills, such as from a rupture in the tank or associated piping, serious environmental damage may result. If the spill is left unchecked, fuel is apt to enter and pollute the ground water. Petroleum spills also waste valuable energy resources and can be extremely costly in terms of lost product, clean-up expense and storage facility downtime.

Government environmental regulations typically require secondary containment of petroleum that has spilled from an above-ground tank. Compliance with such regulations can be quite burdensome. For example, a regulation promulgated by the State of Florida has required that whenever a new above-ground storage tank is constructed in an existing dike field or tank farm facility, an approved secondary containment system must be installed for all existing tanks in the facility. The operator of a fuel storage tank farm is likely to incur costly installation expenses, delays and downtime to comply with this requirement.

Recently, the Florida Department of Environmental Protection has implemented a rule to ease the hardship created by the foregoing regulation. This rule permits the installation of an alternative secondary containment system limited to just the storage tank that is being constructed. If the requirements of the proposed rule are followed, costly and burdensome secondary containment does not have to be installed for all other existing tanks located at the facility.

In order to constitute an acceptable secondary containment system under the new Florida rule, the system must provide the following:

(a) continuous tank shell monitoring with approved probes, cables or electrical sensors;

(b) immediate electronic notification to the storage tank owner/operator of overfills and leaks from the tank shell;

(c) storm water management;

(d) an approved high-high level overfill alarm system with an annual test of operability;

(e) an impervious overfill retention system that will contain a volume of product that would be transferred at maximum flow rate for a period of five minutes by the pump (s) used for filling the tank; and (f) an automatic system for shutting off the pump(s) used for filling the storage tank by an electronic signal from the continuous tank shell monitoring system; the system must be designed to operate in conjunction with the impervious overfill retention system and be capable of preventing any discharge of product being transferred during and after the time needed to shutoff the pump.

There are no previously known secondary containment systems that meet all of the foregoing requirements. The system of the present invention is intended to provide an acceptable alternative secondary containment system as required by the Florida Department of Environmental Protection and has been approved for that purpose.

SUMMARY OF THE INVENTION

It is therefore an object of the present invention to provide an improved secondary containment system for an above-ground petroleum storage tank, which provides for effective secondary containment of leaks, overfilled product and other spills from the tank.

It is a further object of this invention to provide a secondary containment system that is uniquely suited for use with a single above-ground storage tank and which avoids the inconvenience and cost associated with installing an acceptable secondary containment system for an entire dike field or tank farm when only a single new tank is constructed.

It is a further object of this invention to provide a system that constitutes an effective and improved alternative secondary containment system in accordance with governmental regulations, such as those promulgated by the State of Florida, and which may be employed as an effective and cost saving alternative to installing a secondary containment system for an entire dike field or tank farm when only a single new storage tank is constructed.

It is a further object of this invention to provide a secondary containment system that may be installed and utilized effectively and efficiently with both existing and newly constructed tanks in a tank farm.

It is a further object of this invention to provide a secondary containment system that contains petroleum spills from the above-ground storage tanks much more effectively than existing systems, and which significantly reduces the environmental damage, product waste, clean-up costs and tank downtime typically caused by such spills.

It is a further object of this invention to provide a secondary containment system that employs an effective and immediate means of notifying the tank operator of a leak or other spill so that prompt corrective action may be taken.

This invention effectively addresses each of the requirements promulgated by governmental agencies such as the Florida Department of Environmental Protection relating to alternative secondary containment for a new petroleum storage tank. In particular, the system provides for (a) continuous tank shell monitoring; (b) immediate electronic notification of spills; (c) storm water management; (d) an overfill alarm; (e) an impervious overfill retention system; and (f) an automatic pump shut-off system. Each of these constituent parts conforms with promulgated regulatory parameters and standards.

This invention features a secondary containment system for an above-ground petroleum storage tank. The system includes a berm rising above the ground surrounding the tank and spaced apart from the tank for defining a petroleum retention basin about the tank. There is an impermeable liner for extending across and/or covering the ground between the tank and the berm. At least one drain is formed through the liner. The drain includes means for sensing the presence of liquid petroleum in the drain. Means are provided for closing the drain to prevent liquid petroleum from passing therethrough and being discharged from the basin. An indicator device provides at least one of an audible signal and a visual signal indicating that liquid petroleum is sensed in the basin.

In a preferred embodiment, the ground between the tank and the berm is graded to include an upper surface that slopes downwardly between the tank and the berm. The drain may be engaged with the ground at the bottom of the sloped upper surface of the ground. The drain may be engaged with the ground at a lowermost level of the ground surface between the tank and the berm and at lowermost level of the basin.

The impermeable liner may include a geotextile fabric sheet that is anchored to and/or extends across the ground. The sheet may have a water impervious coating of polyurea or the like applied thereto. The liner may cover and be attached to the berm. A trench may be disposed about the tank exteriorly of the berm. In such cases, the liner may extend over the berm and into the trench. Gravel and/or earthen substrates may be disposed above the liner within the trench for securing the liner within the trench. An inner end of the liner may be secured to the tank and, more particularly, the inner end of the liner may be secured to at least one of a ring wall or slab supporting the tank, a steel shell between a pair of bottoms of the tank and an outer shell of the tank.

The means for sealing and the means for closing may include a hydrocarbon filtration media, which discharges rainwater from the basin through a drain sump. Such media responds to contact with a liquid petroleum by absorbing the hydrocarbon and essentially closing the sump to prevent the passage of petroleum therethrough. This prevents petroleum from being discharged from the basin.

The means for sensing may also or alternatively include one or more of an electronic hydrocarbon sensor and a float switch disposed in the drain. An electronic controller may be connected to the float switch and/or hydrocarbon sensor for actuating an indicator device when liquid petroleum is sensed in the drain. The indicator device may include an audible and/or visible alarm, and/or a meter or readout device. In preferred versions, the means for closing may include a shut-off or containment valve that is closed by the controller when liquid petroleum is sensed in the drain to prevent such fuel from draining from the basin into the surrounding tank farm containment.

High level alerts may be mounted to the tank. An overfill switch is operated when the tank is overfilled and the system may further include an overfill indicator responsive to operation of the overfill switch for indicating that the tank is overfilled. Once again, the overfill indicator may include appropriate audible and visible alarms, meters and other types of indicators for alerting the operator of the overfill condition.

The berm may be constructed from earthen materials, reinforced concrete, concrete block, steel sheets and/or synthetic plastic sheets. The height of the berm and the distance from the tank are typically calculated to contain the proper amount of spilled product as per the Florida Department of Environmental Protection or other regulatory requirements or per customer request. This amount should allow the tank operator to perform needed repairs and maintenance to the tank without excessive burden. The berm should be constructed to be taller than the upper surface of the ground exteriorly adjacent to the berm. This means that the height of the berm must be greater than the highest point within the dike area adjacent to the secondary containment system in order to avoid storm water and/or product from an adjacent storage tank draining into the secondary containment system.

DETAILED DESCRIPTION OF PREFERRED EMBODIMENTS

Other objects, features and advantages will occur from the following description of a preferred embodiment and the accompanying drawings, in which.

Figure 1:
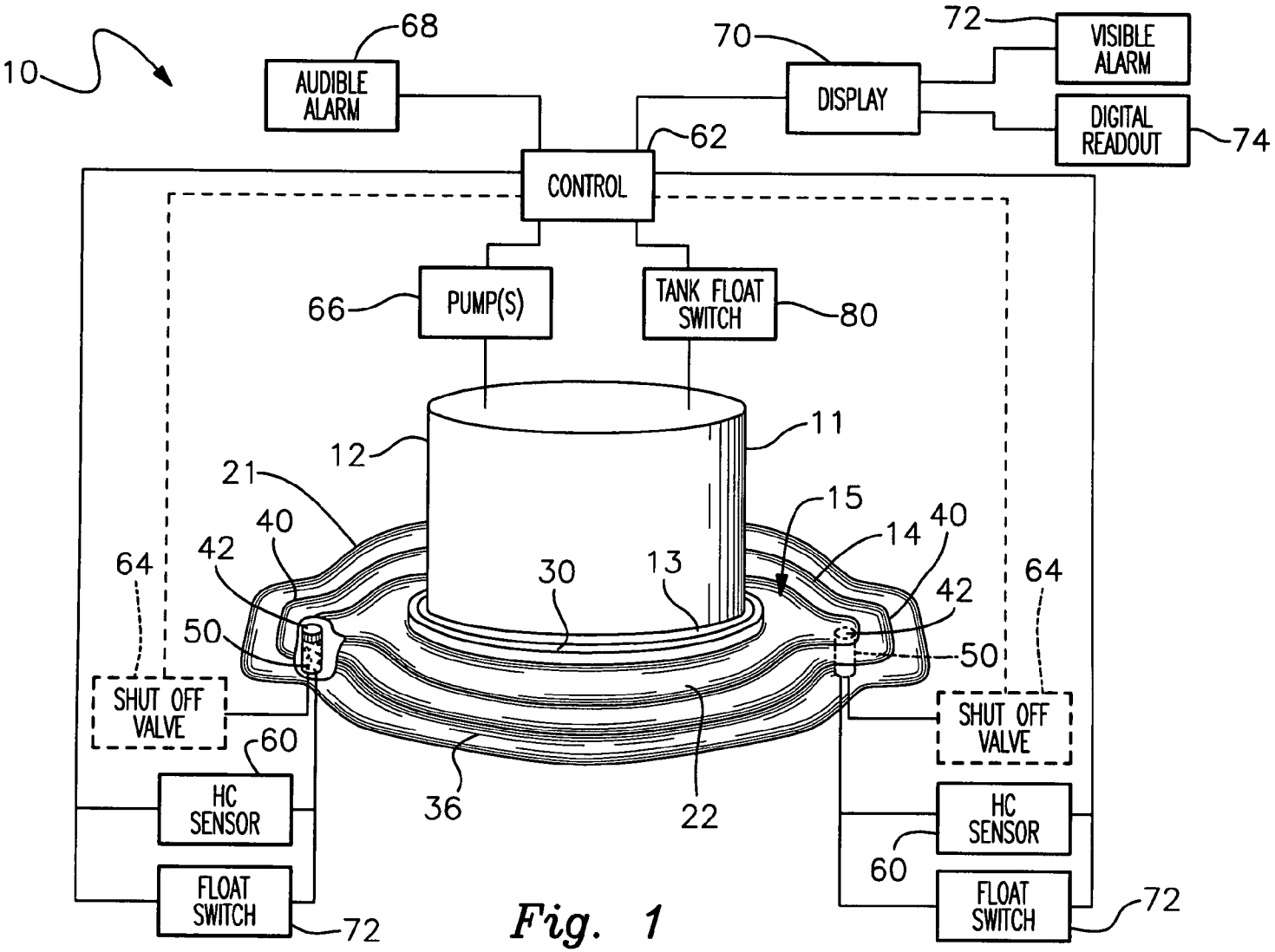
FIG. 1 is a perspective and partially schematic view of a preferred secondary containment system for above-ground petroleum tanks in accordance with this invention.

There is shown in FIG. 1 a secondary containment system 10 for use in connection with an above-ground fuel storage tank 12. It should be understood that secondary containment system 10 may be used effectively for virtually all sizes and types of above-ground petroleum storage tanks. Although the typical tank has a generally cylindrical shape, the particular size, shape and type of tank are not a limitation of this invention. In the version illustrated herein, tank 12 includes a generally cylindrical tank shell 11 that is supported upon a concrete ring wall or slab 13. It should be understood that various alternative tank constructions may be utilized within the scope of this invention.

Tank T is supported upon and surrounded by an underlying sub grade or ground G, which extends generally radially outwardly from the base of the tank. It should be understood, that as used herein, the term "ground" is construed very broadly and may comprise natural earthen materials and/or various other substances including, but not limited to, concrete, asphalt, gravel, synthetics, composites and plastics. A wide assortment of such materials, either alone or mixed, may form the sub grade or ground surrounding the tank and/or upon which the tank is located.

System 10 features components that trap and retain liquid fuel that has spilled from tank 12 due, for example, to a leak in the shell of the tank or in the pipes or other equipment associated with the tank. Fuel spills can also be caused by overfilling the tank. The system also features electronic components for promptly reacting to a fuel spill by shutting off further pumping of fuel into the tank and notifying the owner/operator of the spill so that needed repairs and other corrective action may be effected promptly. The components comprising system 10 have been tested and approved to provide an acceptable alternative dike field secondary containment system as mandated by governmental agencies such as the Florida Department of Environment Protection.

Figure 2:
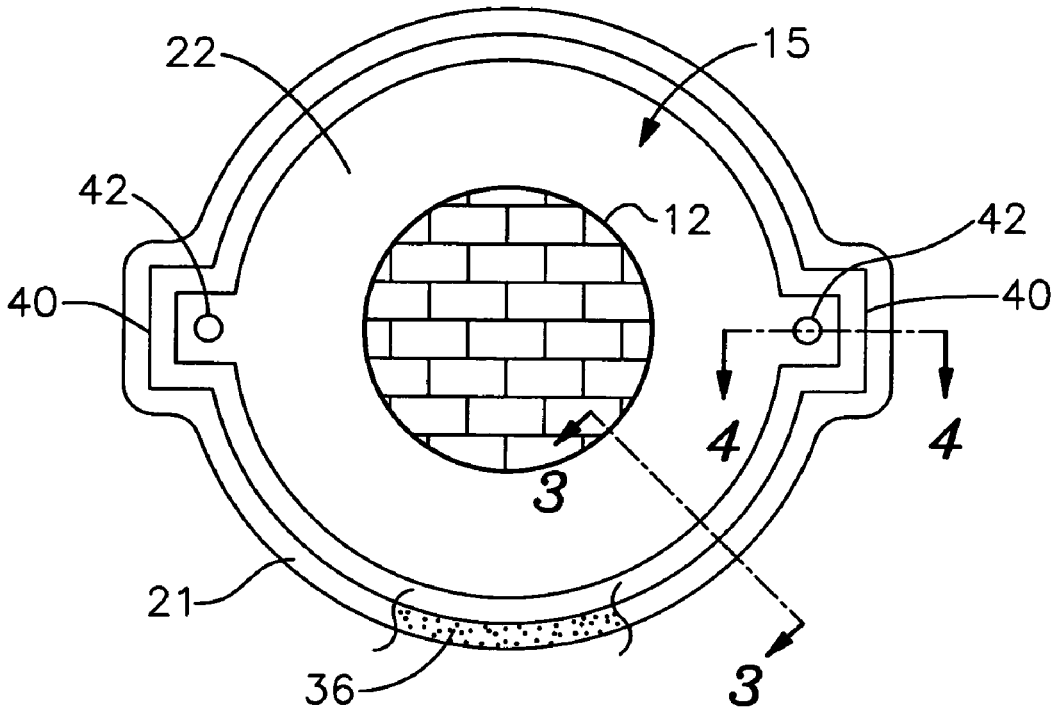
FIG. 2 is a plan view of the preferred system.
Figure 3:
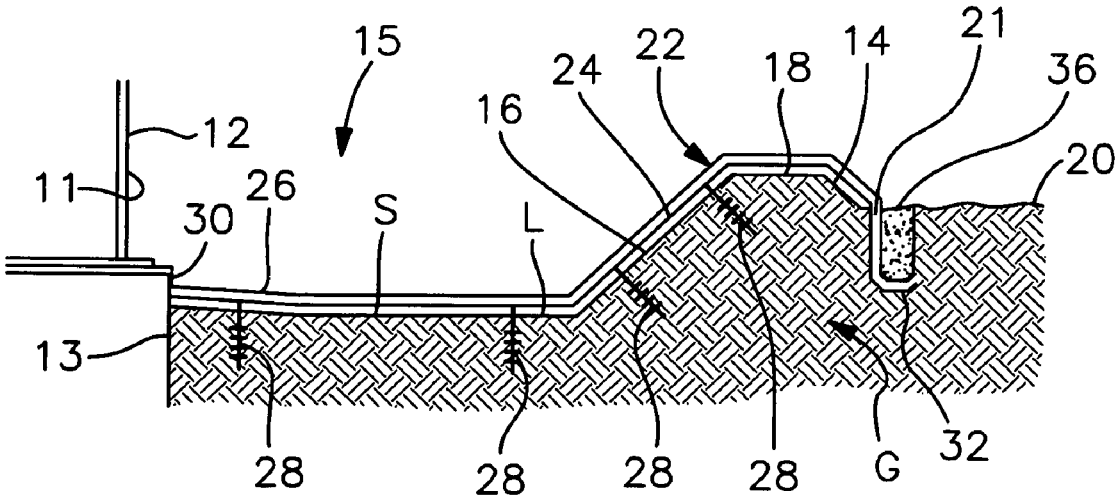
FIG. 3 is a cross sectional view taken along line 3-3 of FIG. 2.

System 10 specifically includes a berm 14 that encircles or otherwise surrounds tank 12. As further depicted in FIGS. 2 and 3, berm 14 comprises a containment wall disposed upon and rising above the underlying ground surface G. The berm thereby defines a spill retention basin 15 between tank 12 and berm 14. The berm may comprise earthen materials such as native or outsourced soils. Additionally or alternatively, the berm may include reinforced concrete, steel sheets driven into underlying ground G, concrete block and/or asphalt. Berm 14 is typically configured in a generally annular fashion about the tank as best shown in FIGS. 1 and 2. It is built at various selected distances from the tank shell in order to provide the needed containment capacity. Preferably, the berm is formed about 5'-20' from the outer wall of the tank shell, although this distance may be varied within the scope of the invention. Berm 14 is constructed to have a height of approximately 12"-24", although such height may again be varied to provide the needed secondary containment capacity about the tank. As best shown in FIG. 3, berm 14 has a sloped inner wall 16 generally facing tank 12. Berm 14 may include various other non-annular configurations suited to conform to the area about the tank available for secondary containment. It is only necessary that the berm peripherally surround the tank so that spilled fuel is retained within the basin defined by the berm. The precise shape of the berm is not a limitation of this invention.

The height of the berm wall and distance from tank 12 are specifically determined so that the containment area defined by the berm is capable of withholding the amount of spilled fuel mandated by applicable governmental requirements or other site specific needs. According to State of Florida regulations, this is the volume of product that would be transferred at a maximum flow rate for a period of 5 minutes by the pump used to fill tank 12. In addition, the berm should be constructed to permit the tank owner/operator to perform needed repairs and maintenance for the tank without being excessively hindered by the berm. As shown in FIG. 3, it is important that the high point 18 of berm 14 be higher than the exteriorly adjacent ground level 20 of the tank field. This prevents storm water and/or spilled fuel from an adjacent tank from draining into basin 15.

The upper surface S of ground G disposed between tank 12 and berm 14 is graded so that it slopes downwardly from the tank to the upwardly sloped wall 16 of berm 14. See FIG. 3. As a result, surface S has a lowermost level L at the bottom of the slope, immediately adjacent berm 14. This also constitutes the lowermost level of basin 15. Preferably, sloped surface S is formed uniformly about the entire perimeter of the generally annular section of ground surface extending between the tank and the berm. In alternative embodiments, surface S may be flat or only sections of surface S may be sloped.

A trench 21 is disposed annularly about tank 12 exteriorly of berm 14 and immediately adjacent to the berm. This trench, which is optional, helps to securely retain an impermeable liner 22 within the spill retention basin. Liner 22 extends across basin 15 and, in particular, covers berm 14 and the intermediate ground surface S formed between tank 12 and berm 14. Liner 22 comprises a geotextile fabric sheet 24, FIG. 3, that is constructed of an industrial fabric composed of woven fibers. Alternative materials may be utilized within the scope of this invention. Sheet 24 forms a substrate to which a liquid polyurea layer 26 impermeable to liquids is applied. Typically layer 26 is spray coated onto the substrate. Polyurea layer 26 is applied at approximately 80 mils dry-film thickness and allowed to dry upon fabric sheet 24. The resulting liquid impermeable liner 22 is extended across basin 15. The liner is secured to the basin by optional anchors 28, FIG. 3, which are driven through liner 22 and into the underlying ground G. In other embodiments, these anchors may be eliminated entirely or replaced by other forms of retention.

As best shown in FIGS. 1 and 3, liner 22 extends from an inner end 50 that engages ring wall 13, across berm 14 and to an outer end 32 disposed within trench 21 encircling the berm. In such cases, polyurea coating is sprayed over the inner end 30 of the underlying geotextile substrate to adhere inner end 30 of liner 22 to the concrete ring along tank shell 12 or between original and second bottoms of the tank shell. In any event, the inner end of the liner is typically secured to or proximate the tank at a convenient location, as determined by the particular tank design. In particular applications, various pipes and/or structural members associated with the tank may protrude through liner 22. In such cases, the liner is prepared to properly cover such structures. This is accomplished by first scarifying the substrate of the associated component to be covered through sand blasting, power tool cleaning or hand tool cleaning so that adhesion between the liner and the tank component is accomplished. Polyurea is then sprayed onto the scarified substrate as the geotextile fabric is applied. This forms a continuous or seamless liner across these associated components located between the tank and the berm.

Exteriorly of berm 14, trench 21 is filled with gravel 36, FIG. 3, which covers the outer edge of the liner and prevents that edge from floating when rainwater enters trench 21. As a result, liner 22 is held securely in place across basin 15 and berm 14, between tank 12 and trench 21. It should be understood that alternative liquid impermeable liner materials, which are environmentally and governmentally approved for use in hydrocarbon secondary containment applications, may be employed for liner 22 within the scope of this invention.

In alternative embodiments the liner may be disposed and extend from tank 12 and across ground G beneath the upper surface S of the ground. In still other cases, the liquid impermeable liner may be extended across the upper surface of the subgrade and concrete or other material may be poured or otherwise installed over the liner to form basin 15. In either event, the liquid impermeable liner prevents leaked fuel from seeping into the ground beneath the liner and potentially entering the water table or causing other environmental damage. The basin can be built to accommodate selected desired volumes of leaked fuel. The impervious liner may comprise a number of alternative materials including, but not limited to HDPE and XR5.

As shown in FIGS. 1 and 2, berm 14 includes a pair of diametrically opposed drain accommodating segments 40 that project radially outwardly from the remainder of generally annular berm 14. In alternative versions of this invention, various other numbers of drains may be utilized. For example, in one embodiment, four drains may be positioned at 90° intervals about the basin. Each drain may be positioned within a respective drain accommodating segment of the berm. In some cases, drain accommodating segments are omitted and the drains are simply placed at the low point within the annular or alternatively shaped berm. In some versions, only a single drain may be employed.

In preferred embodiments of this invention, a hydrocarbon sensor 60, depicted schematically in FIG. 1, is mounted in line within each drain. Sensors 60 may comprise Trace Tek™ brand probes or equivalent devices. Other governmentally approved sensors may be utilized within the scope of this invention. Each sensor 60 is electrically connected to an electronic control device 62, shown schematically in FIG. 1. Sensor 60 detects hydrocarbon fuels floating on water or otherwise entering drain 42. The probe ignores the water but reacts to the presence of fuel. When spilled fuel is sensed in the drain, sensor 60 directs a corresponding signal to control device 62.

The control device may comprise one of various leak detection devices suitable and approved for use in the petroleum storage industry. The Trace Tek™ TTDM-128 control module and other equivalent products featuring known microprocessor based technology may be utilized within the scope of this invention. When control device 62 receives a signal from hydrocarbon sensor 60 indicating that petroleum is present in the drain, the control device generates an output signal that closes a shut-off or containment valve 64 associated with that drain. The drain is thereby sealed to prevent petroleum from being discharged into the underlying ground.

Control device 62 typically contains or is operably connected to appropriate indicator devices such as an audible alarm 68 and/or a visible display 70. The display may comprise a visible alarm 72, such as a flashing light and/or an analog or digital meter, gauge or readout that provides an indication of petroleum levels within the drains. The particular type of audible and visual indicator devices that may be utilized and the means by which those devices interact with and are operated by control device 62 will be known to persons skilled in the art.

In some embodiments, a respective float switch 72 may be mounted within each drain 42 for sensing the presence of spilled petroleum. Such float switches are typically provided in lieu of hydrocarbon sensors 60. Various known and governmentally approved float switches may be employed. Float switch 72 is again electrically connected to control device 62. The float switch is positioned within the drain so that when the petroleum enters and collects in the drain, this eventually trips the float switch. As a result, float switch 72 sends control device 62 a signal indicating that petroleum is sensed in the drain. The controller, in turn, closes shut off valve 64 and activates appropriate audible alarm 68 and/or display 70. In this version, float switch 72 is effectively substituted for hydrocarbon sensor 60 in each drain 40. Control device 60 may also be programmed to deactivate one or more pumps 66 when spilled fuel is sensed in one or more of the sumps. This causes the pump(s) to immediately stop pumping fuel into the tank so that further spillage, fuel losses and potential environmental damage are avoided. In other embodiments, the hydrocarbon sensor and float switch may be utilized jointly within one or more of the drains.

Figure 4:
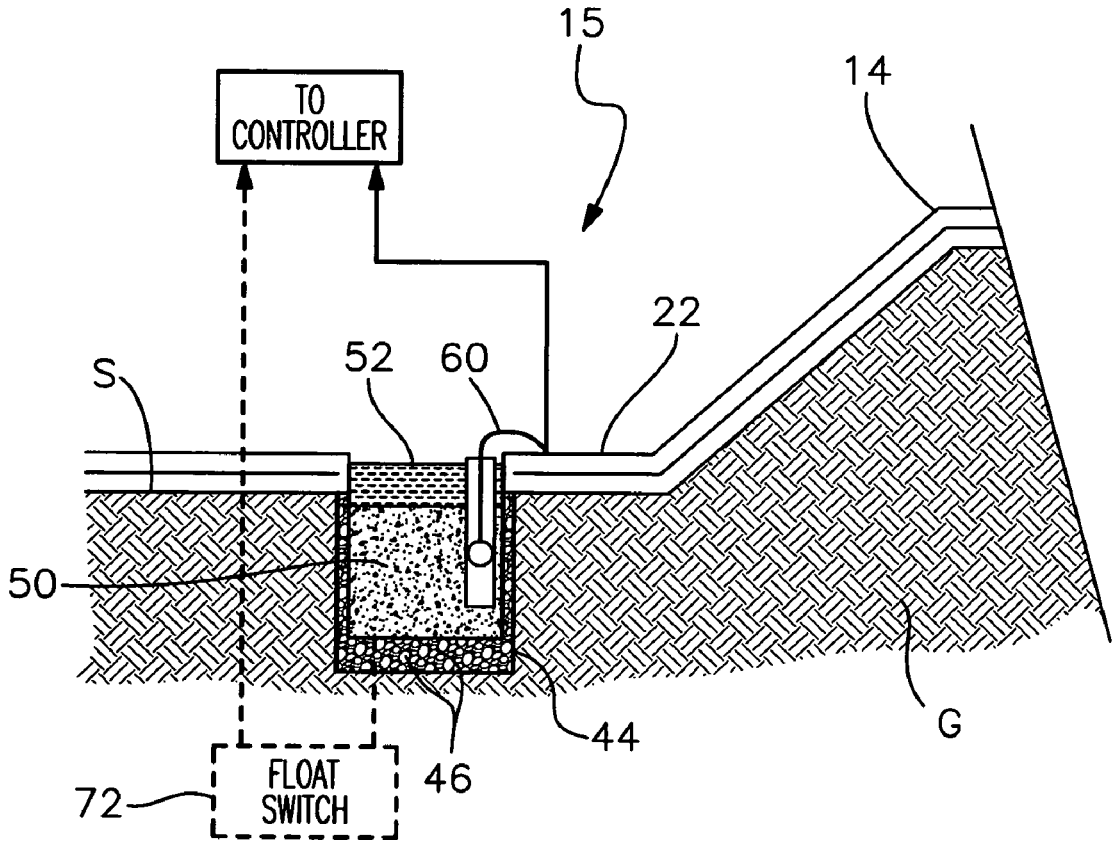
FIG. 4 is a cross sectional view taken along line 4-4 of FIG. 2.
Figure 5:
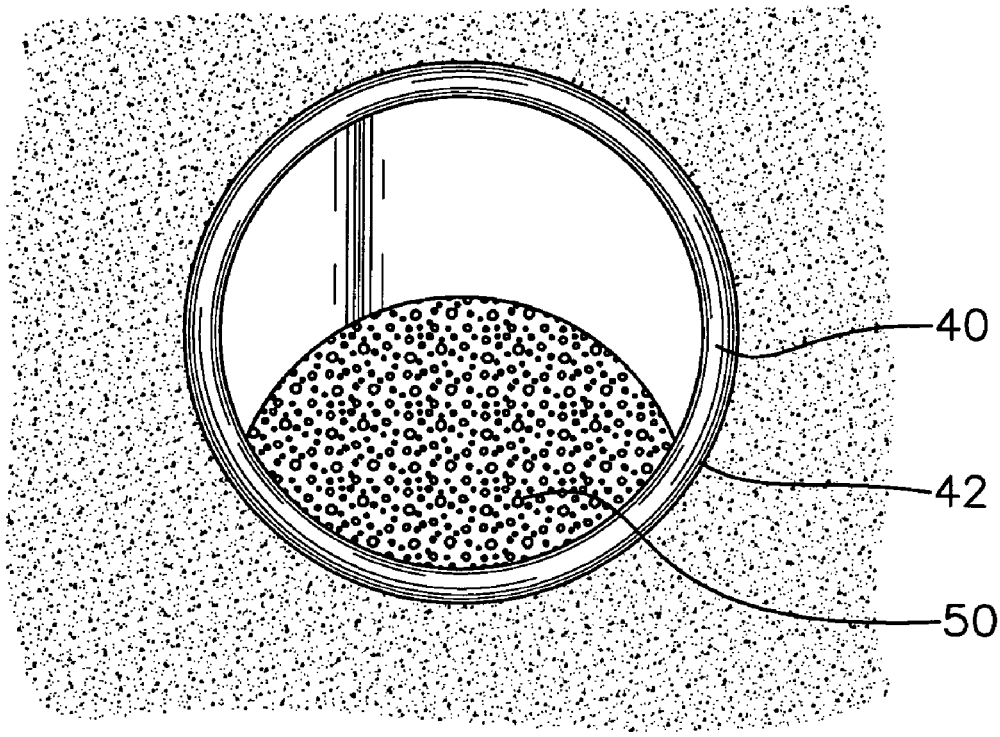
FIG. 5 is a perspective view of the upper end of the drainage sump, with a preferred petroleum sensitive granular media disposed therein.
Figure 6:
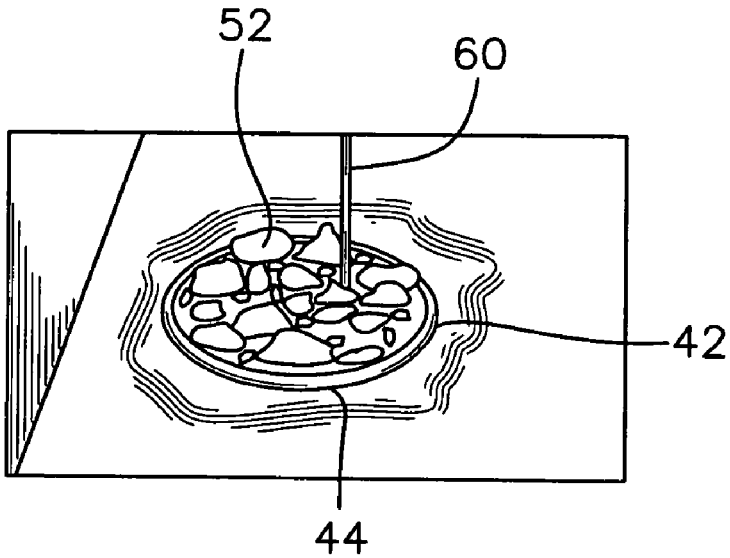
FIG. 6 is a perspective view of the upper end of a representative sump with gravel/aggregate disposed above the media and a hydrocarbon sensor disposed within the sump for detecting the presence of spilled petroleum in the sump.

In an alternative version of this invention, each drain 42 comprises a sump featuring a section of pipe 44, FIGS. 4-6, approximately 36" in diameter and 30"-48" long operably mounted within each of the radially projecting segments 40 of berm 14. The sump pipe 44, which is depicted in FIGS. 4-6, is typically composed of various petroleum resistant materials such as steel, concrete, fiberglass or HDPE. The sump pipe may include alternative materials and dimensions within the scope of this invention. Each pipe 44 extends transversely through and is sealably interengaged with liner 22 and buried vertically in ground G with its upper edge disposed slightly below the grade level of surface S. Each sump pipe 44 is positioned at the lowermost level L (FIG. 3) of basin 15 to provide for acceptable storm water drainage and, at the same time, spilled fuel re-capture in accordance with this invention.

The interior of each pipe 44 is scarified and polyurea is sprayed onto the scarified interior surface of the pipe to seal the pipe with the liner. Gravel 46 is disposed in the bottom of the hole formed by pipe 44. Each drain sump includes means that allow rainwater to drain from basin 15 while preventing spilled petroleum product from being discharged from the basin. Preferably, such means include a petroleum sensitive granular media 50, FIGS. 1, 4 and 5. This media may include the polymer manufactured by Solidification Products International as set forth in U.S. Pat. Nos. 6,435,639, 6,503,390 and 6,841,077. Such material is currently accepted by the Florida Department of Environmental Protection for use in secondary containment drainage systems. An additional thin layer of gravel 52 is placed above media 50 as shown in FIG. 4. Additional filter material such as free flow and filter fabric may be added to the media and/or gravel. Gravel 46 and 52 serve to effectively confine media 50 within sump pipe 44. Sealing media 50 operates in a known manner to permit rainwater and storm water to drain freely from the basin through the sump. If, however, spilled petroleum contacts media 50, the granular media absorbs that petroleum and effectively closes the sump so that spilled fuel is prevented from draining through the sump and being discharged from the basin into the outer containment area.

A hydrocarbon sensor 60, again depicted schematically in FIG. 1, may be installed in each drainage sump in the manner more particularly shown in FIGS. 4 and 6. Sensors 60 are installed longitudinally within respective sump pipes 44 and held in place by the granular sealing media 50 and overlying gravel 52.

System 10 also utilizes a high level and a high-high level float switch 80, FIG. 1, for sensing when the level of petroleum in tank 12 has exceeded predetermined overfill levels. Various float switches which are known for use in the petroleum storage industry may be employed. The high and high-high level switches may comprise a single or multiple float switches. Overfill signals from the tank float switch(es) are directed to control device 62. The control device responds by deactivating pump(s) 66, closing valve(s) 64 and providing notice to the tank operator/owner via audible alarm 68 and/or visible display 70, as appropriate, that the tank is being overfilled. The overfill indicators may comprise the indicators used for notifying the operator of a petroleum spill or may feature separate and distinct indicators.

The display devices and/or alarms may be located at a central location in a tank storage facility. Alternatively, a free standing alarm system may be employed for each storage tank. Such a free standing system will typically constitute an audible alarm and flashing light for each tank. The free standing system will also typically provide appropriate signals to a centralized digital readout display for the storage facility and which control pump operations for the tank in question and/or all tanks of the facility. For example, in certain instances when a leak and/or overfill is detected, it may be advisable to halt all pumping operations in the storage facility.

In the preferred version of this secondary containment system, hydrocarbon sensors detect petroleum in the drain to close respective shut-off valves 64. In operation, during normal rainfall situations and when no fuel spillage is occurring, water collecting in the basin 15 is discharged by drains 42. The water passes through the open shut-off valves 64 because sensors 60 are unaffected by contact with rainwater. The drains are positioned at the lowermost level L of basin 15 so that quick and effective drainage is accomplished.

When tank 12 is overfilled by pump(s) 66, the presence of excessive fuel in tank 12 operates roof mounted float switches 80. This provides a signal to control device 62, which, in turn, shuts off pump(s) 66 to halt the introduction of additional fuel into the tank. Control device 62 may also operate optional shutoff valves 64 to close the drains.

In the event that petroleum leaks from either the tank shell 11 or piping connections associated with the tank (not shown), such spilled petroleum collects within basin 15 defined by berm 14. As previously explained, the berm is sized to hold a volume equal to approximately 5 minutes of fuel pumping at full capacity for any and all pumps feeding tank 12. This provides adequate time for the components of the system to operate so that the spilled petroleum is not discharged from basin 15 and further pumping into the tank (if any) is halted. The presence of petroleum in a drain activates the associated electronic hydrocarbon sensor. Sensor 60 directs a signal to control device 62, which closes shut-off valves 64 to close drains 42. Device 62 also shuts off pump(s) 66 feeding the tank and provides audible and/or visual notification of a leak to the tank operator. In preferred cases, where a shut-off valve is used, the signal from the hydrocarbon sensor directs controller 62 to operate shutoff valve 64 and close the drain.

Figure 7:
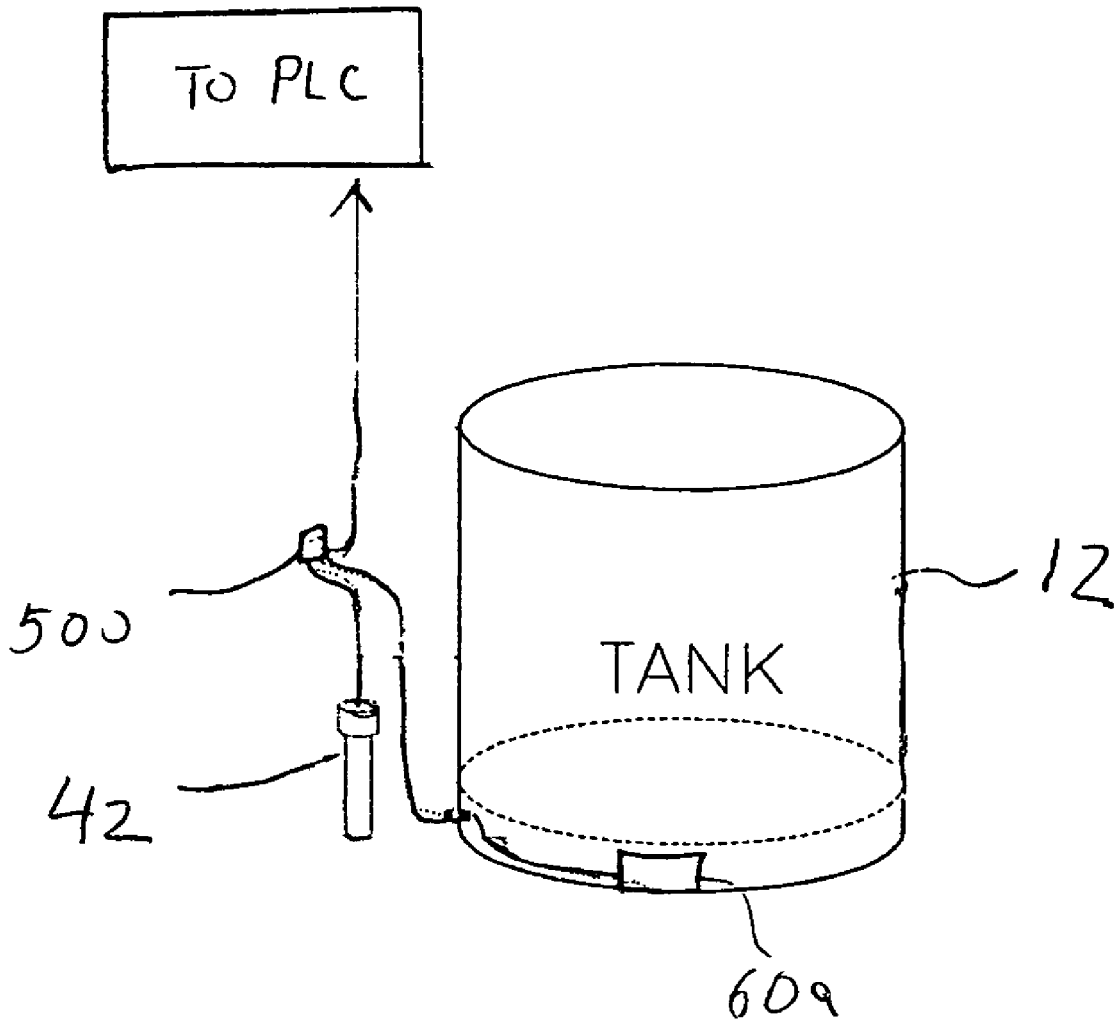
FIG. 7 is a schematic view of a tank with hydrocarbon sensors placed in the ground directly beneath and adjacent to the tank.

FIG. 7 schematically depicts an alternative sensor arrangement wherein a hydrocarbon sensor 60*a* is disposed beneath the center of tank 12. Sensor 60*a* may be used alone for detecting leaks or in conjunction with one or more previously described hydrocarbon sensors 42. A fuel leak may be detected by either sensor 60*a* or sensor 42, which, in turn, directs a leak detection signal through connector 500 and therefrom to a PLC or other type of controller/display/alarm system, as previously described in connection with FIG. 1. Various other types and placements of sensors may be employed within the scope of this invention. In addition, various types of controls, alarms and/or data displays may be utilized.

In alternative versions using the petroleum sensitive media, when the leaked hydrocarbons enter the sump(s), they immediately react with the granular sealing media. The media absorbs petroleum entering the sump. This effectively closes the drainage sump. In such cases an adjunct hydrocarbon sensor/float switch may be used to provide an alert or warning signal to control device 62. The control, once again, deactivates the pump or pumps 66 feeding the tank and activates appropriate audible and visible indicators to notify the operator of the leak. Prompt and unmistakable notification is provided to the operator. This allows timely corrective action to be taken so that costly and potentially environmentally disastrous petroleum spills are avoided. Such corrective action typically involves repairing the leak and/or discontinuing pumping operation until the overfill condition is alleviated.

The present invention provides for an acceptable and governmentally approved alternative secondary containment system in accordance with Florida Department of Environmental Protection regulations. Specifically, system 10 meets each of the following parameters:

(a) Continuous tank shell monitoring with approved probes, cables or electrical sensors. These include hydrocarbon sensor 60, float switch 72, control device 62, alarm 68 and display 70 (comprising visible alarm 72 and/or digital readout 74).

(b) Immediate electronic notification to the owner of overfills and leaks from the tank shell or piping. Once again, see sensor 60, float switch 72, control 62, tank float switches 80, audible alarm 68, visible alarm 72 and digital readout 74.

(c) Effective storm water management, which is particularly accomplished using drains/sumps positioned at lowermost levels of the spill retention basin and the containment valves, granular media or other means for closing the drains in the presence of petroleum.

(d) High level and high-high level overfill alarm system. See tank float switch 80, control 62 and the previously described alarms.

(e) An impervious overfill retention system that contains a volume of product that would be transferred at a maximum flow rate for a period of five minutes by the pump used for filling the tank. See the berm 14, sloped ground surface S and impermeable liner 22.

The system of this invention meets all of the requirements of the Florida Department of Environmental Protection regulations as currently promulgated and provides for both effective containment of petroleum spills and immediate notification of such spills to the tank operator so that timely and effective correction action can be taken.

From the foregoing it may be seen that the apparatus of this invention provides for a secondary containment system for an above-ground petroleum storage tank and, more particularly, to a system for capturing petroleum that has leaked or otherwise spilled from an above-ground storage tank or the piping associated therewith. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

1. A secondary containment system for an above-ground petroleum storage tank, said system comprising:

a berm rising above the ground surrounding the tank and spaced apart from the tank for defining a petroleum retention basin above the tank;

an impermeable liner for extending across the ground between the tank and said berm, an inner end of said liner being sealable engaged with at least one of a ring wall or slab supporting the tank, a steel shell between a pair of bottoms of the tank and a shell of the tank;

at least one water drain formed through said liner, said drain including means for sensing the presence of liquid petroleum in said drain;

means for closing said drain to prevent liquid petroleum from passing therethrough and being discharged from said basin; and an indicator device for providing at least one of an audible signal and a visual signal indicating that liquid petroleum is sensed in said drain.

2. The system of claim 1 in which the ground between the tank and said berm is graded to include an upper surface that slopes downwardly between the tank and said berm.

3. The system of claim 2 in which said drain is engaged with the ground at a bottom of the sloped upper surface of the ground.

4. The system of claim 1 in which said drain is engaged with the ground at a lowermost level of the ground surface between the tank and said berm and at a lowermost level of said basin.

5. The system of claim 1 in which said impermeable liner includes a geotextile fabric sheet.

6. The system of claim 5 in which said sheet has an impermeable coating applied thereto.

7. The system of claim 1 in which said liner covers and is attached to said berm.

8. The system of claim 7 further including a trench disposed about the tank exteriorly of said berm.

9. The system of claim 8 in which said liner extends over said berm and into said trench and further including gravel for securing said liner within said trench.

10. The system of claim 1 in which an inner end of said liner is secured to the tank.

11. The system of claim 1 in which said means for sensing includes a hydrocarbon sensor.

12. The system of claim 1 in which said means for sensing includes a float switch.

13. The system of claim 1 further including a control device responsive to said means for sensing for actuating said indicator device when liquid petroleum is sensed in said sump.

14. The system of claim 13 in which said means for closing includes a shut off valve that is closed by said control device when liquid petroleum is sensed in said sump to prevent liquid petroleum from draining through said sump from said basin into the underlying ground.

15. The system of claim 1 in which an overfill float switch is mounted to said tank, said overfill switch being operated when the tank is overfilled and further including an overfill indicator responsive to operation of said overfill float switch for indicating that the tank is overfilled.

16. The system of claim 1 in which said means for sensing and said means for closing comprise a petroleum sensitive granular sealing media for discharging drain water from said basin, said media being responsive to contact with a liquid petroleum for absorbing the petroleum to prevent such petroleum from passing therethrough and draining beyond said basin.

17. The system of claim 1 in which said berm is constructed to be taller than the upper surface of the ground exteriorly adjacent to said berm.

18. The system of claim 16 in which said means for sensing further includes a monitor for detecting the presence of liquid petroleum in said drain independently of said media, and a control device responsive to said monitor for actuating said indicator device when liquid petroleum is sensed in said drain.

19. A secondary containment system for an above-ground petroleum storage tank, said system comprising:

a berm rising above the ground surrounding the tank and spaced apart from the tank for defining a petroleum retention basin about the tank;

an impermeable liner for extending across the ground between the tank and said berm, said liner being engaged with at least one of a ring or slab supporting the tank, a steel shell between a pair of bottoms of the tank and a shell of the tank;

at least one water drain formed through said liner and, said drain containing a valve for discharging rainwater from said basin;

a hydrocarbon sensor for sensing the presence of a liquid petroleum in said drain;

a containment valve that is alternatable between open and closed conditions within said drain;

a control device responsive to said hydrocarbon sensor for closing said valve when liquid petroleum is sensed in said drain; and an indicator device responsive to said control device for providing at least one of an audible signal and a visual signal indicating that liquid petroleum is detected in said sump.

20. A secondary containment system for an above-ground petroleum storage tank, said system comprising:

a berm rising above the ground surrounding the tank and spaced apart from the tank for defining a petroleum retention basin above the tank;

an impermeable liner for extending across the ground between the tank and said berm, said liner being attached to at least one of a ring wall or slab supporting the tank and a shell of the tank;

at least one water drain formed through said liner, said drain including means for sensing the presence of liquid petroleum in said drain;

means for closing said drain to prevent liquid petroleum from passing therethrough and being discharged from said basin; and an indicator device for providing at least one of an audible signal and a visual signal indicating that liquid petroleum is sensed in said drain.

* * * * *

UNITED STATES PATENT AND TRADEMARK OFFICE

CERTIFICATE OF CORRECTION

PATENT NO. : 7,874,764 B2
APPLICATION NO. : 12/462749
DATED : January 25, 2011
INVENTOR(S) : Van Fossen et al.

It is certified that error appears in the above-identified patent and that said Letters Patent is hereby corrected as shown below:

On title page delete item (12) "Fossen et al." and insert item (12) --Van Fossen et al.--.

Signed and Sealed this
Twenty-sixth Day of April, 2011

David J. Kappos
*Director of the United States Patent and Trademark Office*